US005295341A

United States Patent [19]

Kajiwara

[11] Patent Number: 5,295,341

[45] Date of Patent: Mar. 22, 1994

[54] SNAP-TOGETHER FLOORING SYSTEM

[75] Inventor: Matsuji Kajiwara, Bellevue, Wash.

[73] Assignee: Nikken Seattle, Inc., Tukwila, Wash.

[21] Appl. No.: 911,986

[22] Filed: Jul. 10, 1992

[51] Int. Cl.[5] ..... E04C 1/30

[52] U.S. Cl. ..... 52/586.2; 404/41

[58] Field of Search ..... 52/589.595, 392, 589; 404/41

[56] References Cited

U.S. PATENT DOCUMENTS

| | | | |
|---|---|---|---|
| 1,361,501 | 12/1920 | Schepmoes | 52/590 |
| 1,946,690 | 2/1934 | Haines | 52/386 |
| 3,248,838 | 5/1966 | Stark | 52/481 |
| 3,310,919 | 3/1967 | Bue et al. . | |
| 3,397,496 | 8/1968 | Sohns | 52/286 |
| 3,619,963 | 11/1971 | Omholt | 52/483 |
| 3,657,852 | 4/1972 | Worthington et al. | 52/591 |
| 3,694,983 | 10/1972 | Couquet | 52/384 |
| 3,859,000 | 1/1975 | Webster | 52/589 |
| 3,946,529 | 3/1976 | Chevaux | 52/390 |
| 4,023,596 | 5/1977 | Tate | 138/111 |
| 4,606,156 | 8/1986 | Sweers et al. | 52/126.6 |
| 4,759,164 | 7/1988 | Abendroth et al. | 52/403 |
| 4,769,963 | 9/1988 | Meyerson | 52/309.9 |
| 5,052,158 | 10/1991 | D'Luzansky | 52/177 |

FOREIGN PATENT DOCUMENTS

| | | | |
|---|---|---|---|
| 2251762 | 5/1974 | Fed. Rep. of Germany | 52/592 |
| 3044664 | 7/1982 | Fed. Rep. of Germany | 52/386 |
| 1341279 | 9/1963 | France | 52/586 |
| 345451 | 5/1960 | Switzerland | 404/41 |
| 812671 | 4/1959 | United Kingdom | 52/594 |

*Primary Examiner*—James L. Ridgill, Jr.
*Attorney, Agent, or Firm*—Seed and Berry

[57] ABSTRACT

A flooring system having a base member having a top side, an underside, and four circumferentially spaced outer edges, a tongue connector secured to one outer edge by an interlocking rib and groove, a groove connector secured to another outer edge by an interlocking rib and groove, the tongue connector having forwardly converging compressible sidewalls terminating in rear transverse locking surfaces, the groove connector having an enlarged inner opening and a smaller outer opening, the tongue sidewalls in a compressed position being smaller than said groove outer opening to pass through the outer opening but elastically expandable to be larger than said outer opening to lock a tongue in a groove.

9 Claims, 5 Drawing Sheets

SNAP-TOGETHER FLOORING SYSTEM

DESCRIPTION

1. Technical Field

This invention pertains to flooring units or panels, either in the form of elongated planks or in smaller rectangular or square parquet, and more particularly, to interconnecting adjacent such units together by a simple snap-together locking system.

2. Background of the Invention

Flooring in the form of elongated planks or strips and rectangular or square parquet panels are well known. Generally it is desirable to be able to inter-fit the flooring so that it has a tight inter-fit and an outer appearance devoid of large gaps or cracks. In general, it is also desirable that the flooring be easily and quickly assembled, to reduce installation costs.

Various techniques in the past have been proposed for providing such flooring and flooring systems. U.S. Pat. No. 3,310,919 shows a flooring system in which interlocking flooring units are engaged by tongue and grooves with interlocking screws locking a groove to a tongue. U.S. Pat. No. 3,657,852 shows interlocking tongue and grooves with the panels or units having to be overlaid and tilted to allow the tongue to fit within the groove.

While the known prior art systems have been adequate in many cases, they are not adequate in locations where speed of installation is of the essence, and the interlock must be tight.

SUMMARY OF THE INVENTION

It is an object of this invention to provide a flooring that can be interconnected one to another to make up a flooring system in which each of the individual flooring or flooring units is interlocked by a mechanical interlock system that can be quickly snapped together at the installation site without the need for tools.

Furthermore, it is another object of this invention to provide a versatile flooring system in which individual flooring units such as planks or parquet squares or other shapes can be inter-fitted together in various different patterns simply by snapping together the flooring to make the total system.

In one embodiment, the flooring has base members, each with four outer peripheral edges. A tongue connector is attached to one outer edge and a groove connector is attached to another of the outer edges. The groove connector has an outer opening of a reduced width, and an inner opening with a width greater than the width of the outer opening. The tongue has a forward end with forwardly converging opposed elastically flexible sidewalls. The sidewalls can be compressed toward one another to form a transverse width smaller than the outer opening of the groove. The expanded width of the sidewalls of the tongue, however, is greater than the outer opening of the groove, so that once the tongue is inserted into a groove the tongue can expand in the inner opening of the groove and provide positive interlocking abutting surface between the tongue and the groove to hold the two base members together. Preferably, the connectors are attached to the base members in recesses in the outer edges by additional tongues and grooves. The connectors are preferably attached to the base members at the factory during manufacture.

As is readily apparent, the flooring can be interconnected together quickly and positively locks in a variety of patterns to enable rapid construction of the flooring system in the dwelling or other structure.

The base member generally will have a top side covered by a wood veneer or other attractive wear surface, and an underside which may be covered by a rubber cushion layer.

The flooring units when assembled can have various different arrangements of their outer peripheral edges connected to one another, and in the case of the elongated planks the planks may be laid side-by-side, end-for-end, or with an end abutting a side.

DETAILED DESCRIPTION OF THE INVENTION

Figure 1:
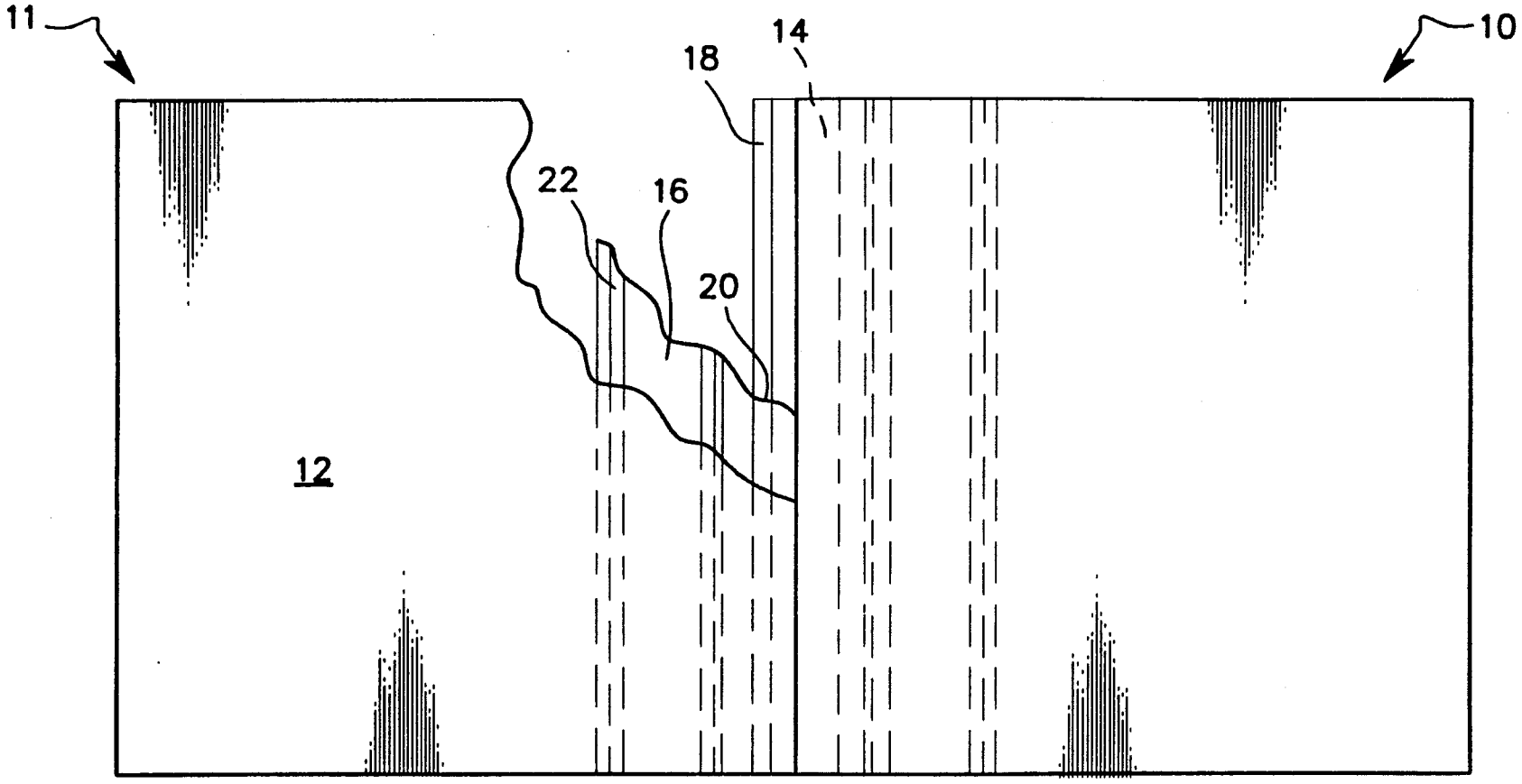
FIG. 1 shows a flooring unit of the invention locked together with another flooring unit to form the flooring system.

As best shown in FIG. 1, a typical flooring unit 10 can be rectangular or square of the parquet type or an elongated plank. A second flooring unit 11, identical to flooring unit 10, can be interconnected to flooring unit 10. The arrangement of units connected can be different lengths and widths to fit the size of the room in which the flooring is to be laid.

Figure 2:
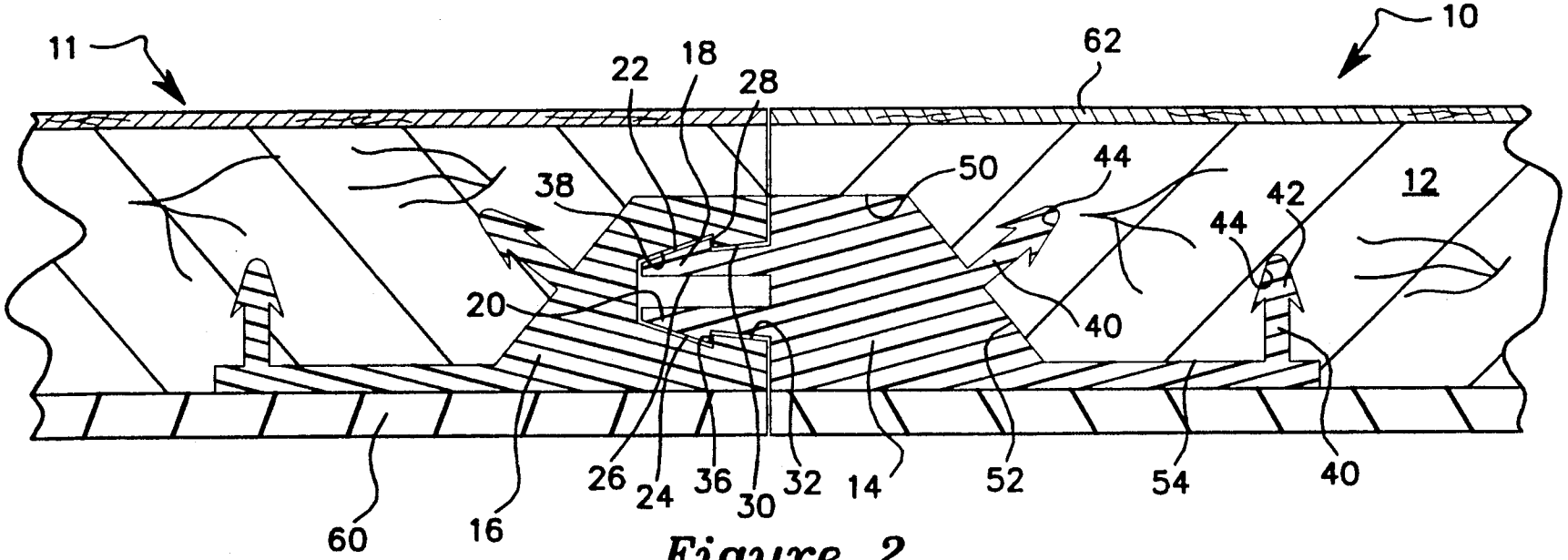
FIG. 2 is a fragmentary vertical cross section through two interconnected flooring units.

As best shown in FIG. 2, a flooring unit includes a base member 12. The base member of each flooring unit except for its dimensions is identical, so only one will be described. Preferably, the base member is plywood or other solid, durable material. The base member for flooring unit 10 has a tongue connector 14 attached to it. A groove connector 16 is attached to flooring unit 11. All connectors are preferably made from plastic having some flexibility. The tongue connector has a forwardly protruding tongue 18. The groove connector has a forwardly protruding groove 20.

The tongue is provided with a pair of forwardly diverging sidewalls 22 and 24 separated by an elongated groove 26. The sidewalls terminate rearwardly at transverse rear locking surfaces 28. The sidewalls can be compressed together to a narrower width, and are made of elastic or resilient plastic to naturally expand outwardly into an enlarged width as shown in FIG. 2.

The groove 20 has an outer opening 30 with inwardly converging sidewalls 32 which terminate at substantially transverse intermediate locking surfaces 36. The intermediate locking surfaces 36 partly form an enlarged inner opening 38 of a size slightly larger than the periphery of the sides of the sidewalls of the tongue when in its expanded position. The outer opening 30, however, is smaller in cross-section than the width of the inner sidewalls of the tongue, so that the transverse rear locking surfaces 28 of the tongue overlay and abut against the intermediate locking surfaces 36 of the groove.

As is readily apparent, by forcing the tongue into the groove the sidewalls of the tongue compress into the center groove or slot 26, allowing the sidewalls to pass beyond the outer opening of the groove 30. Once past the outer opening, the sidewalls of the tongue expand into the position in FIG. 2 to positively interlock the two connectors together.

Each connector is provided with additional tongues or ribs in the shape of barbs 40 having enlarged heads 42 that fit into elongated grooves 44 in the base member. Two such tongues 40 and grooves 44 are provided for each connector. The grooves 44 and the tongues 40 run the entire length of an outer edge of the base member. Preferably the base member is cut away or recessed with a flat surface 50, a sloping surface 52, and a bottom flat surface 54 substantially parallel to the surface 50.

Preferably each base member has its underside covered by a cushioning layer 60 and its top surface covered by a wood veneer or other hard finish decorative surface 62.

Figure 4:
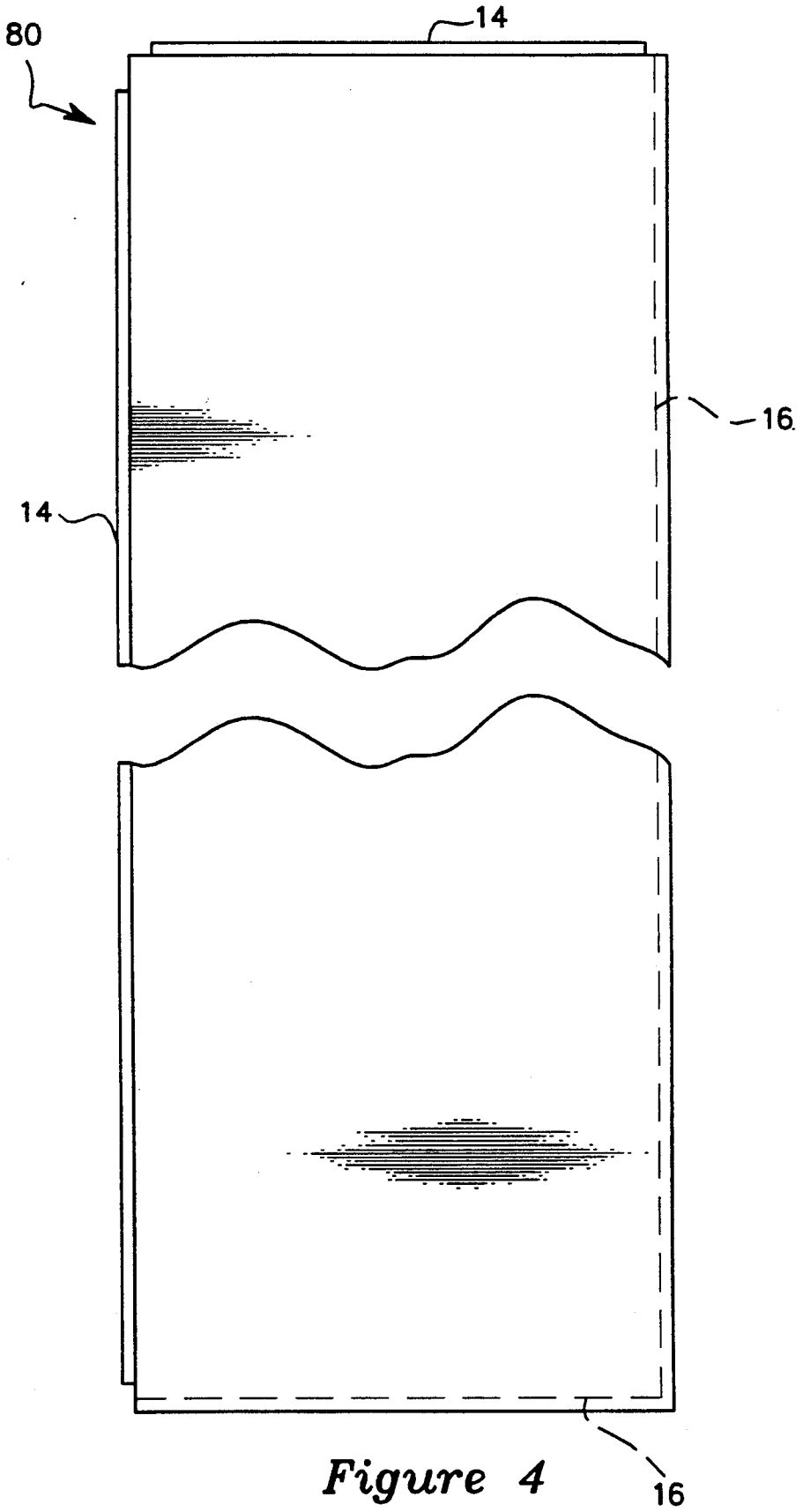
FIG. 4 is a plan view of a second embodiment of an elongated plank with grooves and tongues running the full length of the side edges of the plank.
Figure 5:
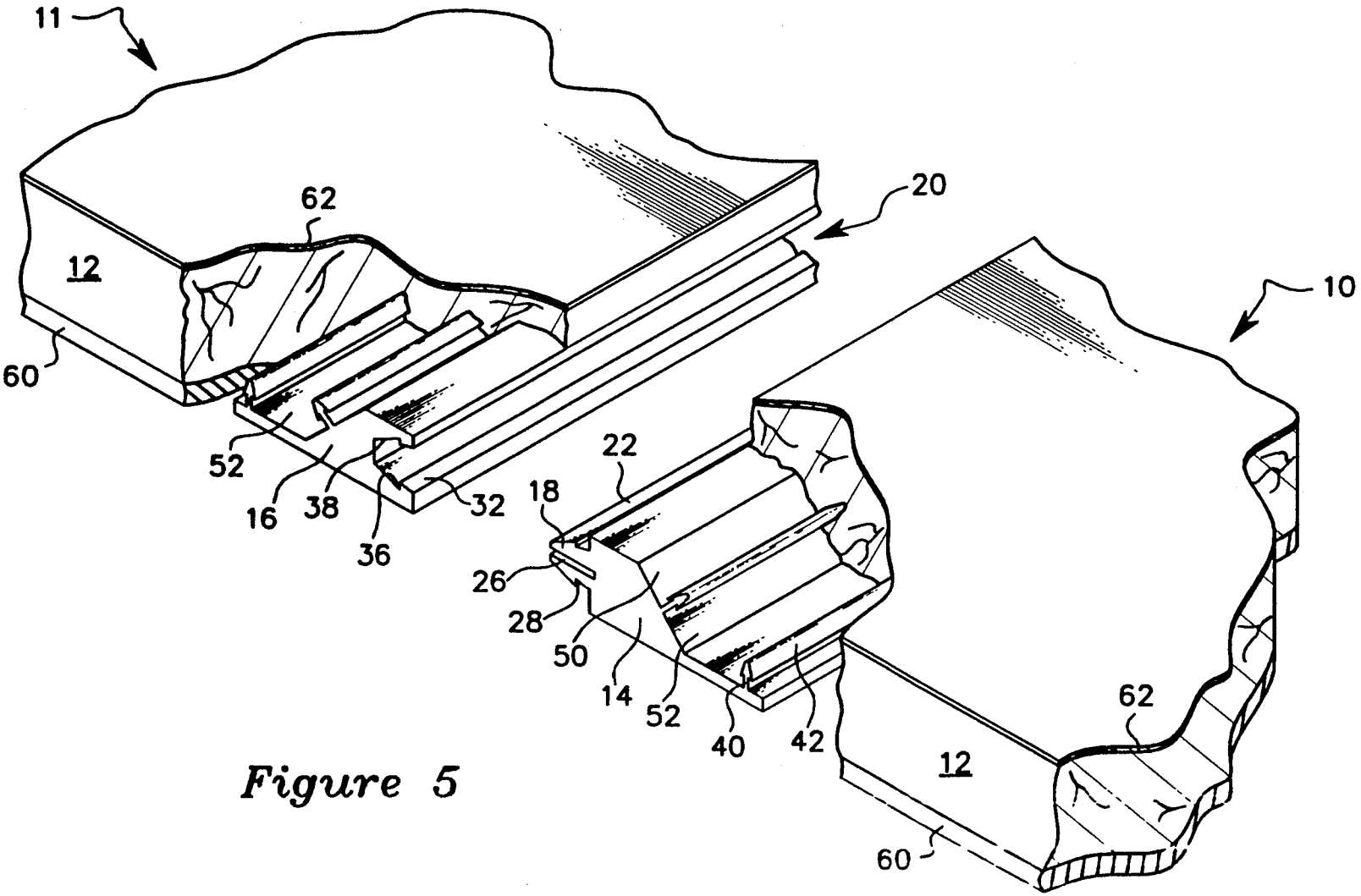
FIG. 5 is a fragmentary isometric exploded view of the invention.

Normally the peripheral outer edges of the planking or of a square or rectangular parquet unit will be as in FIG. 4 and in a circumferential direction around the unit will have one edge with a groove connector 16, the next edge with a tongue connector 14, the next edge with another tongue connector 14 and the final edge around the periphery being another groove connector 16. Also, the arrangement of alternating tongue and groove connectors around the circumference of the flooring unit is also feasible.

Figure 3:
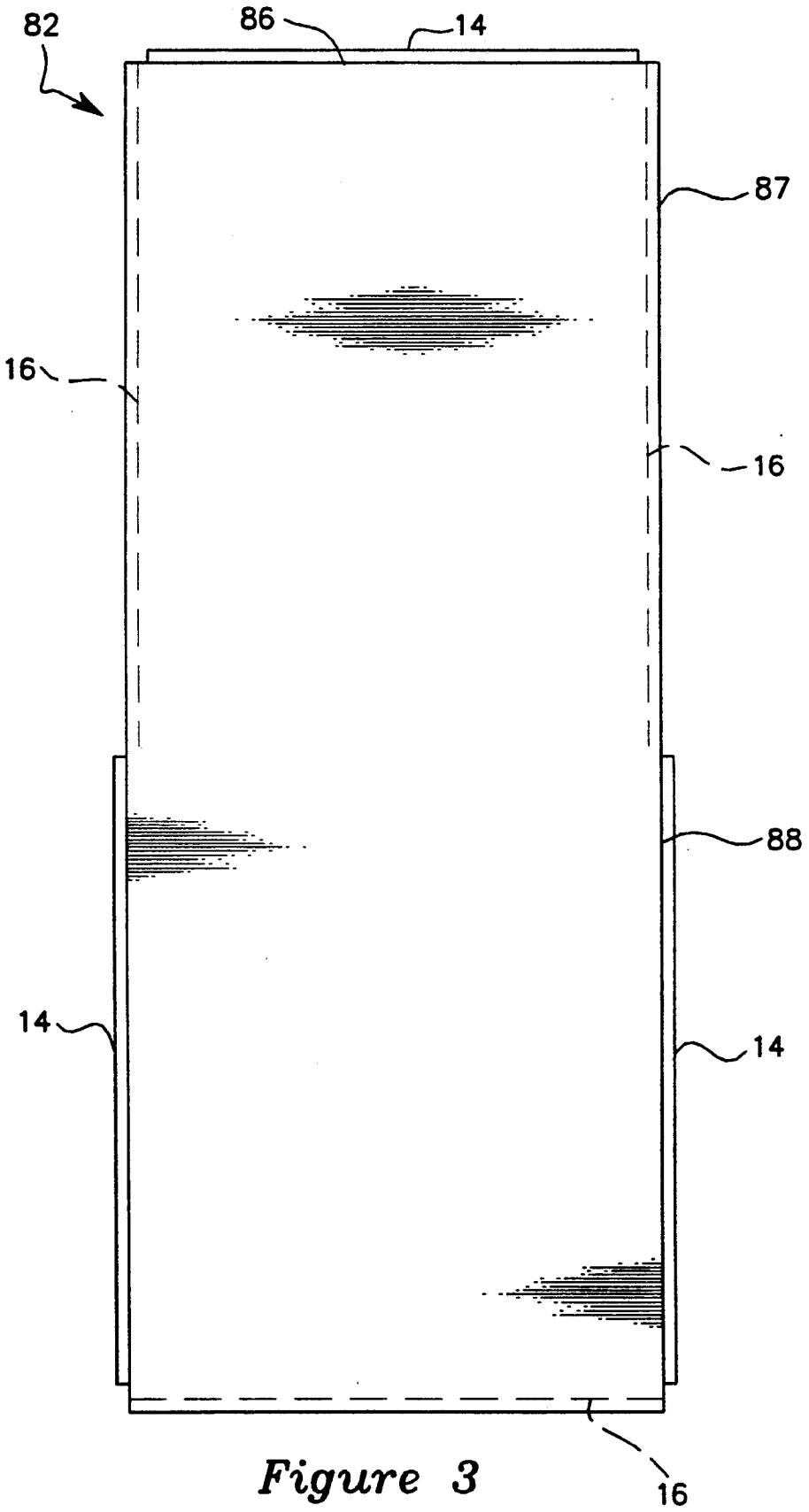
FIG. 3 is a plan view of an elongated plank of one embodiment of the invention.

In the embodiment shown in FIG. 3, a planking 82 will have a tongue connector 14 at one end, a groove connector 16 at the opposite end, but will have a groove connector 16 for one half of an elongated side and a tongue connector 14 for the remaining half. Likewise on the opposite elongated side, a tongue connector 14 will be for one half and a groove connector 16 will extend for the other half. In this arrangement, the end 86 of one plank can be inserted against a sidewall 87 with the tongue connector 14 fitting in the groove connector 16. A second plank can then be fitted against the remainder of the sidewall 88 with a groove connector 16 of that plank fitted into the tongue connector 14 of the side 88. Alternatively, the planks 82 can be interconnected side-by-side.

As is readily apparent, installation of the planking or parquet units is quite quick and simple. A supply of the units is delivered to the job site. The workman needs only begin snapping the units together quickly, until the entire room is made up. No special tools of any kind are needed.

While the preferred embodiments of the invention have been illustrated and described, it should be apparent that variations will be apparent to one of ordinary skill in the art without departing from the principles herein. Accordingly, the invention is not to be limited to the specific embodiments shown in the drawing.

I claim:

1. A snap-in flooring system having a plurality of base members, a surface sheet on each base member, and connector means for interlocking the base members to one another, said connector means including an elongated groove on one base member and an elongated tongue on the other base member, said tongue and groove having an interlocking overlapping fit with abutting confronting locking surfaces, said interlocking fit being resiliently overcome by deflecting the tongue to allow the tongue to insert into the groove along a path of insertion until the abutting confronting locking surfaces overlap to lock the base members together, said tongue having a forward end with forwardly converging sidewalls separated by a slot, the sidewalls terminating rearwardly in rear locking surfaces substantially transverse to said tongue and at least ninety degrees at its forward angle to the path of insertion between the tongue and the groove, said groove having a forward end with forwardly diverging sidewalls, said groove sidewalls terminating rearwardly in intermediate locking surfaces substantially transverse to said groove and also at least ninety degrees at its forward angle to the path of insertion between the tongue and the groove, said tongue slot lying along the path of insertion between the tongue sidewalls to allow the tongue sidewalls to elastically bend toward one another, wherein said tongue sidewalls bend toward one another to reduce the space between the tongue sidewalls so that the tongue sidewalls pass inwardly in the groove until the tongue rear locking surfaces pass the groove intermediate locking surfaces and then the tongue expands so that the tongue rear locking surfaces overlap and abut said groove intermediate locking surfaces, said mating tongues and grooves extending for substantially the entire width and length of said surface sheets, said groove having an outer opening with inwardly and forwardly converging sidewalls, and said tongue having rearward sidewalls also converging inwardly and forwardly and mating with said groove outer opening sidewalls.

2. The system of claim 1, said tongue having a forward end with forwardly converging sidewalls separated by a slot, the sidewalls terminating rearwardly in rear locking surfaces substantially transverse to said tongue, said groove having a forward end with forwardly diverging sidewalls, said groove sidewalls terminating rearwardly in intermediate locking surfaces substantially transverse to said groove, and wherein said tongue sidewalls are compressible to reduce the space between the tongue sidewalls so that the tongue sidewalls pass inwardly in the groove until the tongue rear locking surfaces pass the groove intermediate locking surfaces and then the tongue expands so that the tongue rear locking surfaces overlap and abut said groove intermediate locking surfaces.

3. The system of claim 1, said connector means having a plurality of attaching ribs each with an inner head end connected to a narrower stem, said base member having elongated grooves matching said inner head end, each said head end and said elongated groove in said base member having overlapping abutting surfaces of a width greater than said stem to lock the rib to the base member.

4. The system of claim 1, said base member having four outer edges, the outer edges being in order about the circumference of the base member a tongue, tongue, groove and groove.

5. The system of claim 1, said base member being an elongated plank having four outer edges, said outer edges around the circumference of the plank having a tongue, a groove for one half of an edge and a tongue for the second half of the edge, a groove, a tongue for one half of the remaining edge and a groove for the second half of the remaining edge.

6. The system of claim 1, said base member having an underside and including a resilient cushioning layer secured to the underside of the base member.

7. A flooring having a base member having four peripheral outer edges, a top side, and an underside, a first connector attached to one outer edge and having an elongated elastically compressible tongue, the tongue having a first transverse width when in its normal condition and a second smaller transverse width when compressed, another of said outer edges having a groove, said groove having an inner opening and an outer opening greater in transverse width than said inner opening, said tongue normal width in its normal condition being greater than said groove outer opening but smaller than said groove outer opening when the tongue is compressed;

said tongue having a forward end with forwardly converging sidewalls separated by a slot, the sidewalls terminating rearwardly in rear locking surfaces substantially transverse to said tongue and at least ninety degrees at its forward angle to the path of insertion between the tongue and the groove, said groove having a forward end with forwardly diverging sidewalls, said groove sidewalls terminating rearwardly in intermediate locking surfaces substantially transverse to said groove and also at least ninety degrees at its forward angle to the path of insertion between the tongue and the groove, said tongue slot lying along the path of insertion between the tongue sidewalls to allow the tongue sidewalls to elastically bend toward one another, wherein said tongue sidewalls bend toward one another to reduce the space between the tongue sidewalls so that the tongue sidewalls pass inwardly in the groove until the tongue rear locking surfaces pass the groove intermediate locking surfaces and then the tongue expands so that the tongue rear locking surfaces overlap and abut said groove intermediate locking surfaces, said mating tongues and grooves extending for substantially the entire width and length of said surface sheets, said groove having an outer opening with inwardly and forwardly converging sidewalls, and said tongue having rearward sidewalls also converging inwardly and forwardly and mating with said groove outer opening sidewalls.

8. The flooring of claim 7, said connector being attached to said base member by interlocking sets of ribs and grooves, each rib having an enlarged inner head, each groove having an enlarged inner opening, the enlarged head of a rib locking into the enlarged inner opening of a groove for holding the connector onto the base member.

9. The flooring of claim 8, each said base member outer edge having a flat upper surface, a sloping intermediate surface connected to said flat upper surface, and a flat lower surface connected to said intermediate surface and spaced inwardly of the base member underside.

* * * * *